US007252143B2

(12) United States Patent
Sellers et al.

(10) Patent No.: US 7,252,143 B2
(45) Date of Patent: Aug. 7, 2007

(54) METHOD AND APPARATUS FOR ANCHORING TOOL IN BOREHOLE CONDUIT

(75) Inventors: Freddie L. Sellers, Arlington, TX (US); Stanley R. Thomas, Jr., Houston, TX (US); Lucio N. Tello, Benbrook, TX (US)

(73) Assignee: Computalog USA Inc., Fort Worth, TX (US)

( * ) Notice: Subject to any disclaimer, the term of this patent is extended or adjusted under 35 U.S.C. 154(b) by 182 days.

(21) Appl. No.: 10/853,595

(22) Filed: May 25, 2004

(65) Prior Publication Data

US 2005/0263280 A1 Dec. 1, 2005

(51) Int. Cl.
*E21B 47/00* (2006.01)

(52) U.S. Cl. ..... 166/217; 73/152.56; 166/250.13; 166/382

(58) Field of Classification Search ..... 166/301, 166/178, 250.13, 382, 216, 217; 73/152.26, 73/152.56

See application file for complete search history.

(56) References Cited

U.S. PATENT DOCUMENTS 2,695,820 A * 11/1954 Segesman ..... 166/241.5
3,661,205 A * 5/1972 Belorgey ..... 166/66.4
3,686,943 A 8/1972 Smith
3,798,966 A * 3/1974 Planche ..... 73/152.02
4,104,911 A 8/1978 Lavigne et al.
4,105,071 A 8/1978 Nicolas et al.
4,181,196 A 1/1980 Darby et al.
4,402,219 A 9/1983 Hache
4,610,309 A * 9/1986 O'Brien et al. ..... 166/382
4,694,902 A * 9/1987 Hormansdorfer ..... 166/250.13
4,715,469 A * 12/1987 Yasuda et al. ..... 166/212
4,844,197 A 7/1989 Maissa
5,060,751 A 10/1991 Kuhlman et al.
5,585,555 A 12/1996 McRae

* cited by examiner

*Primary Examiner*—Jennifer H. Gay
*Assistant Examiner*—Robert Fuller
(74) *Attorney, Agent, or Firm*—Geoffrey A. Mantooth

(57) ABSTRACT

A free point tool has at least one sensor to measure deformation of a stuck conduit in a borehole. A set of anchors is located adjacent to and on each side of the sensor. The anchors include anchor arms that move from a stowed position to an extended position. Each of the anchor arms has a pad, which pad has a contact face. The contact face is structured and arranged to engage the conduit. The pad is coupled to the respective anchor arm in an articulating manner, such as by a pin joint or a ball and socket joint. The pad can be easily coupled to or disconnected from the arm. This allows the pad to be selected for the downhole conditions, including conduit physical characteristics and environmental conditions downhole. The anchors also include cam arms coupled between the anchor arms and an actuator. There are provided at least two sets of anchor linkages of cam arms and anchor arms so as to adapt to the conduit inside diameter.

8 Claims, 5 Drawing Sheets

Prior Art

METHOD AND APPARATUS FOR ANCHORING TOOL IN BOREHOLE CONDUIT

FIELD OF THE INVENTION

The present invention relates to methods and apparatuses that anchor tools in conduits located in oil and gas wells.

BACKGROUND OF THE INVENTION

Conduits, such as drill string, tubing, or casing are inserted into or pulled from oil and gas boreholes. During the insertion or removal process, the conduit may become stuck.

When the conduit is stuck, the operator determines the depth of the stuck point. Once the stuck point is determined, the conduit above the stuck point can be backed off or cut at a location just above the stuck point and the conduit is then removed.

To determine the stuck point, a tool is inserted into the conduit. The tool is commonly referred to as a free point tool; its role is to find the location just above the stuck portion of the conduit, referred to as the free point.

The free point tool is lowered to a depth and then coupled to the conduit by way of anchors. The anchors deploy out to engage the inside diameter of the conduit. In the prior art, the anchors are arms, the ends of which have serrations designed to contact a range of conduit inside diameters.

Once the anchors engage the inside diameter of the conduit, torsional and tensional deformations are applied to the conduit from the surface. The free point tool has sensors that measure the local torsional and tensional deformations downhole. Based upon comparison of these measurements to the applied loads, the free point of the stuck conduit can be determined.

With the prior art anchors, the anchors may slip and render the measurements inaccurate or suspect. This is because only part of the serrations contact the conduit inside surface. What is needed is an anchor that will hold more securely.

SUMMARY OF THE INVENTION

It is an object of the present invention to provide a free point tool with anchors that securely hold the tool to the conduit during measurements.

It is another object of the present invention to provide a method for selecting an appropriate anchoring system suitable for downhole conditions.

The invention provides an apparatus for locating a free point in a stuck conduit in a borehole. There is at least one sensor to measure deformation of the conduit. A set of anchors is located adjacent to, and on each side of the sensor. The anchors comprise anchor arms that move from a stowed position to an extended position. Each of the anchor arms has a pad with a contact face on one end, the contact face being structured and arranged to engage the conduit. Each pad is coupled to the respective anchor arm in an articulating manner.

In accordance with one aspect of the present invention, the pads are coupled to the anchor arms by respective pin joints.

In accordance with another aspect of the present invention, the pads are coupled to the anchor arms by respective ball joints, universal joints, flexible couplings, or any other means of local articulation.

In accordance with still another aspect of the present invention, the contact face comprises teeth that are arranged across a length of the contact face.

In accordance with still another aspect of the present invention, the contact face comprises teeth arranged across a length and width of the contact face.

In accordance with still another aspect of the present invention, the contact face of each pad is curved in a circumferential direction so as to improve conformance with the conduit.

In accordance with still another aspect of the present invention, the contact face of each pad comprises teeth arranged in a pattern with a channel between at least some of the teeth so as to allow for debris exit upon loading of the pad against the conduit.

In accordance with still another aspect of the present invention, the pad is removably coupled to the respective anchor arm.

The present invention also provides an apparatus for anchoring to stuck conduit in a borehole and for locating a free point of the stuck conduit. The apparatus comprises a measurement unit for measuring torsion and tension of the conduit. A set of anchors is located on each side of the measuring unit. Each set of anchors has a tool body. Each of the anchors comprises an arm that has a first end and a second end, with the first end of the arm being pivotally coupled to the tool body. Each set of anchors has an actuator that moves the arms between a stowed position, wherein the free end of each arm is against the tool body, and a deployed position, wherein the free end of each arm is out away from the tool body. Each of the arms has a pad, which pad has a contact face with plural projections spaced in a longitudinal direction with respect to the tool body. The pad is pivotally coupled to the free end of the arm such that substantially all of the projections in a longitudinal direction can make contact with the conduit when the arm is in the deployed position.

In accordance with another aspect of the present invention each pad has plural projections spaced in a circumferential direction.

In accordance with another aspect of the present invention the contact face of each pad has curvature in a circumferential direction.

In accordance with still another aspect of the present invention the pads are removably coupled to the respective arms.

In accordance with still another aspect of the present invention, the arm is an anchor arm. Each of the anchors comprise a cam arm having a first end and a second end, with the first end of the cam arm being coupled to the actuator and the second end of the cam arm being pivotally coupled to the anchor arm at a pivot point. The cam arm and the anchor arm being an anchor linkage. At least first and second sets of anchor linkages are provided for each anchor, with the first set of anchor linkages forming a perpendicular angle between the respective cam arm and anchor arm for a small size conduit and the second set of anchor linkages forming a perpendicular angle between the respective cam arm and anchor arm for a larger size conduit.

The present invention also provides a method of locating a free point in a stuck conduit in a borehole using a free point tool that has at least one sensor to measure deformation of the conduit and a set of anchors on each side of the sensor for securing the tool to the conduit during deformation measurements. The method determines the borehole conditions downhole. Anchor pads are selected for the downhole conditions. The selected anchor pads are mounted to the anchors. The tool is lowered into the conduit and then secured to the conduit by engaging the anchor pads with the conduit.

In one aspect of the present invention, the step of determining the downhole borehole conditions further comprises determining the physical characteristics of the conduit and the anchor pads are accordingly selected.

In another aspect of the present invention the step of determining the downhole borehole conditions further comprises determining the environmental conditions downhole and the anchor pads are selected accordingly.

In still another aspect of the present invention the step of mounting the selected anchor pads to the anchors comprises mounting the anchor pads in an articulated manner to the anchors.

In still another aspect of the present invention, the method provides that the step of determining the borehole conditions downhole further comprises the step of determining the inside diameter of the conduit. Anchor linkages are selected from among at least two sets of anchor linkages, with one set of anchor linkages being more suitable for smaller diameter conduits than the other set of anchor linkages. The step of mounting the selected anchor pads to the anchors comprises the step of mounting the selected anchor pads to the selected anchor linkages.

The present invention also provides an apparatus for locating a free point in a stuck conduit in a borehole. The apparatus comprises a measurement unit for measuring torsion and tension on a conduit. An anchor unit is located on each side of the measuring unit. Each anchor unit has a tool body and plural anchors. Each anchor is selected from first and second sets of linkages. Each set of linkages comprise an anchor arm that has an inner end and an outer end. The anchor arm inner end being pivotally coupled to the tool body. The anchor arm outer end structured and arranged to engage the inside diameter of the conduit. Each set of linkages comprise a cam arm that has an inner end and an outer end. The cam arm inner end is pivotally coupled to an actuator that can move in a longitudinal direction of the tool body. The cam arm outer end is pivotally coupled to a pivot point of the anchor arm. The pivot point is between the anchor arm inner and outer ends so that an angle is formed between the cam arm and the portion of the anchor from the pivot point to the anchor arm inner end. The first set of linkages form the angle as perpendicular when the respective anchor arm outer end is a first distance from the respective tool body. The second set of linkages form the angle as perpendicular when the respective anchor arm outer end is at a second distance from the tool body. The first distance is shorter than the second distance, wherein the first set of linkages can be used with a conduit having a small inside diameter and the second set of linkages can be used with a conduit that is larger than the inside diameter.

In accordance with one aspect of the present invention, the first set of linkages has a shorter cam arm than the cam arm in the second set of linkages.

In still another aspect of the present invention, the pivot point on the anchor arm in the first set of linkages is closer to the anchor arm outer end than the pivot point on the anchor arm of the second set of linkages.

The present invention also provides a method of locating a free point in a stuck conduit in a borehole using a free point tool having at least one sensor to measure deformation in the conduit and a set of anchors on each side with a sensor for securing the tool to the conduit during deformation measurements. The inside diameter of the conduit in the borehole is determined. At least two sets of anchor linkages are provided, with the first set of anchor linkages forming an angle between the respective cam arm and anchor arm as perpendicular when the anchor arm is extended to a first distance and the second set of anchor linkages forming an angle between the respective cam arm and anchor arm as perpendicular when the anchor arm is extended a second distance that is greater than the first distance. One of the sets of anchor linkages is selected according to the conduit inside diameter and the anchor linkage is then mounted to the free point tool.

BRIEF DESCRIPTION OF THE DRAWINGS

FIG. 9A shows the anchor linkage in a small diameter conduit. FIG. 9B shows the anchor linkage in a conduit of larger diameter than FIG. 9A. FIG. 9C shows the anchor linkage extended to an undesirable geometry.

DESCRIPTION OF THE PREFERRED EMBODIMENT

Figure 1:
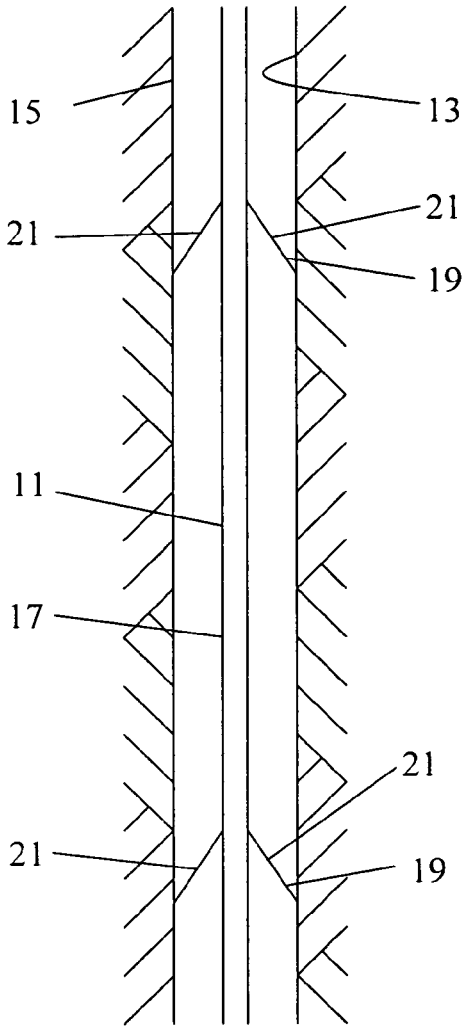
FIG. 1 shows a free point tool located in a borehole.

FIG. 1 shows a free point tool 11. The tool is inserted into conduit 13, (i.e., casing, tubing, or pipe), inside of the borehole 15. The borehole 15 is typically an oil or gas well.

The tool has a measurement section 17. The measurement section has sensors and electronics for measuring a torsion and tension of the conduit. The measurement section also telemeters the measurement data to the surface, either by a wire or by other telemetry methods. U.S. Pat. No. 4,105,071, the disclosure and description of which are incorporated by reference herein, discusses measurement sensors and the measuring process.

The tool 11 is provided with upper and lower anchor assemblies 19, respectively located above and below, or on each side of, the measurement section 17. The anchor assemblies 19 have a number of anchor arms 21, or dog arms, that deploy between a stowed position and a deployed position. In the stowed position, the arms are brought in close to the body of the tool and in most, if not all, practical designs, the arms are retracted into the tool body to minimize snagging. In the deployed or extended position, the arms 21 are extended out, as shown in FIG. 1, with the outer portions of the arms engaging the inside diameter of the conduit 13.

The anchor arms 21, and their associated apparatuses, engage the inside diameter of the conduit to anchor, or secure, the free point tool 11 to the conduit so that measurements can be taken. The present invention provides a unique outer end, or pad, on each of the anchor arms to increase the holding ability and minimize slippage of the free point tool inside of the conduit. In addition, the anchor arms themselves are designed to increase the holding ability. Furthermore, the anchor arms can be disengaged from the conduit to move the free point tool to another location or the surface for retrieval.

Figure 2:
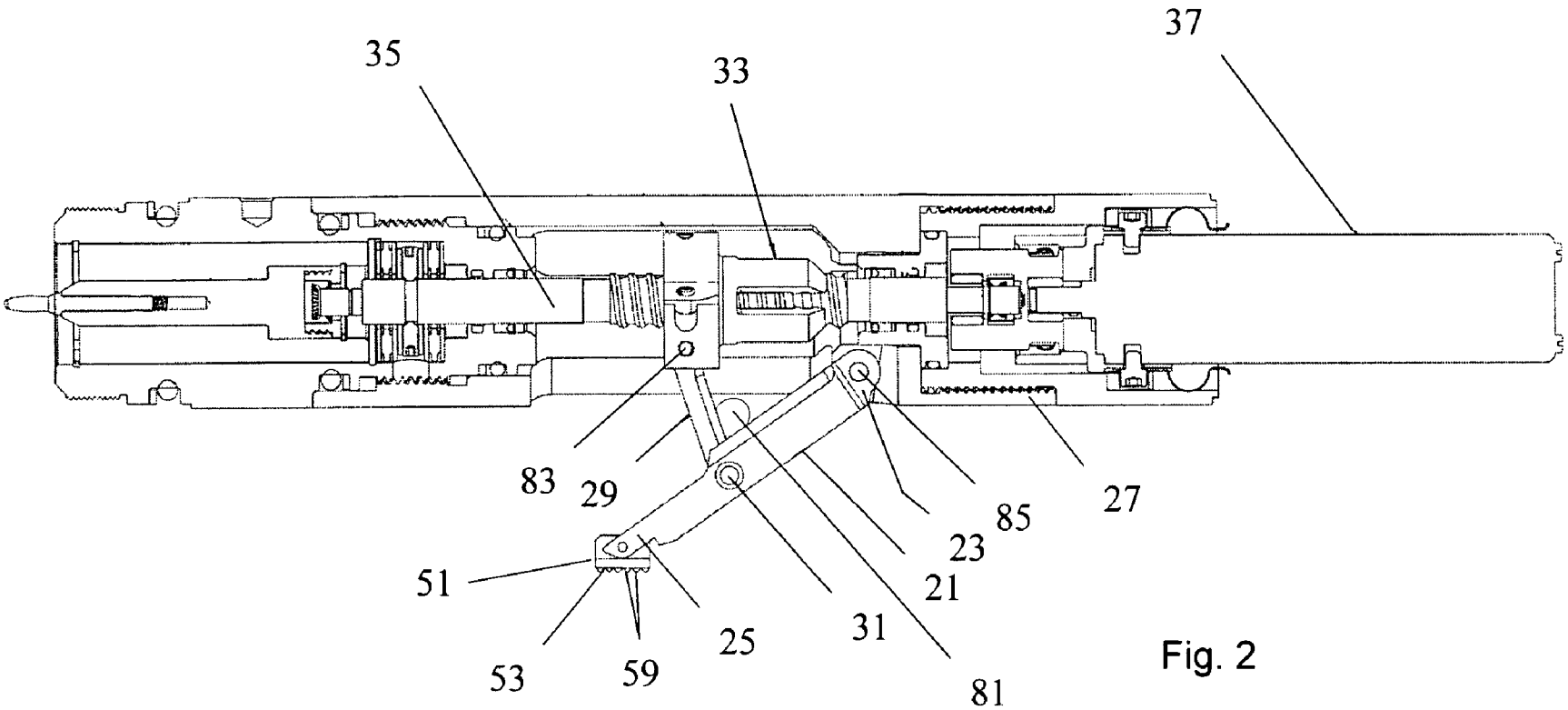
FIG. 2 shows the actuating mechanism for the anchor arms, in accordance with a preferred embodiment.

The actuating mechanism for moving the anchor arms 21 between the deployed and stowed positions and for maintaining the anchor arms in those positions, can utilize a variety of technologies. FIG. 2 illustrates the preferred embodiment. In FIG. 2, only one anchor arm 21 is shown. Each anchor assembly can include three or more anchor arms. The anchor arms are evenly spaced apart (for example, an anchor assembly with three anchor arms has the anchor arms spaced 120 degrees apart). Similar prior art on these aspects of tool design can be seen in U.S. Pat. No. 4,402,219 the disclosure and description of which are incorporated herein for reference.

Each anchor arm has a fixed end 23 and a free end 25. The fixed end 23 is pivotally coupled to the tool body 27. The central portion of the anchor arm pivotally connects to a cam arm 29 by way of a pinned connection 31. The cam arm 29 extends from the anchor arm 21 to a collar 33. The collar 33 can move longitudinally within the tool body 27. The relative size and length of the anchor arm—cam arm linkage, as well as the pin locations can be proportionately changed to provide different ranges of mechanical advantage. As the collar 33 moves toward the fixed ends 23 of the anchor arms (to the right in the orientation shown in FIG. 2), the anchor arms are deployed radially out. As the collar 33 moves away from the fixed ends 23 of the anchor arms (to the left in the orientation shown in FIG. 2), the anchor arms move into their stowed positions. The collar 33 has interior threads that mate with a threaded rod 35. A motor 37 turns the threaded rod 35 to move the collar 33 and the anchor arms 21. The motor 37 is electric or could be hydraulic. Various other actuating mechanisms could be used, such as hydraulic, spring-backed, etc.

Figure 3:
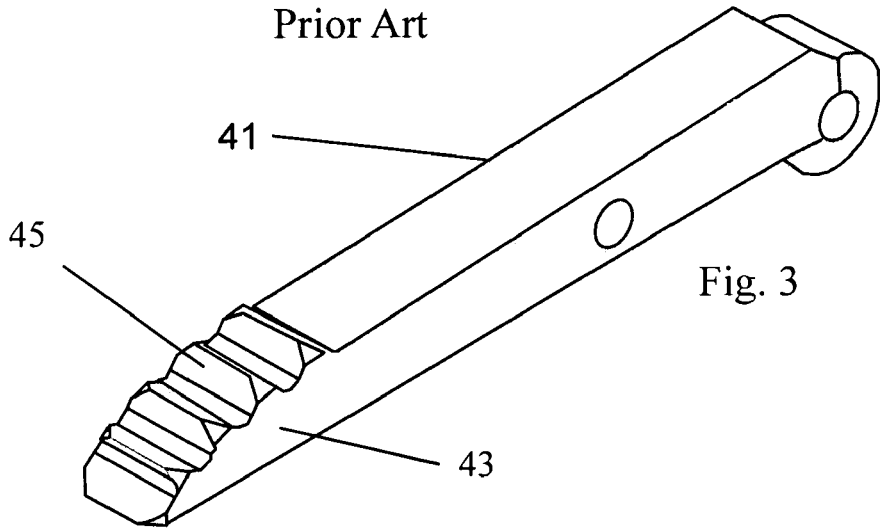
FIG. 3 shows a prior art anchor arm.

A prior art anchor arm 41 is shown in FIG. 3. The free end 43 of the anchor arm has serrations 45 and is radiused so as to engage a range of conduit inside diameters. In small inside diameter conduits, the serrations nearest to the center of the arm 41 contact the conduit, while the serrations located at or near the free end of the arm typically do not contact the conduit. In larger inside diameter conduits, the serrations nearest the center of the arm do not contact the conduit, with the serrations located at or near the free end of the arm typically do contact the conduit. Because not all of the serrations contact the conduit for any given conduit, the anchor arm is unable to provide satisfactory and secure coupling to the conduit.

Figure 4:
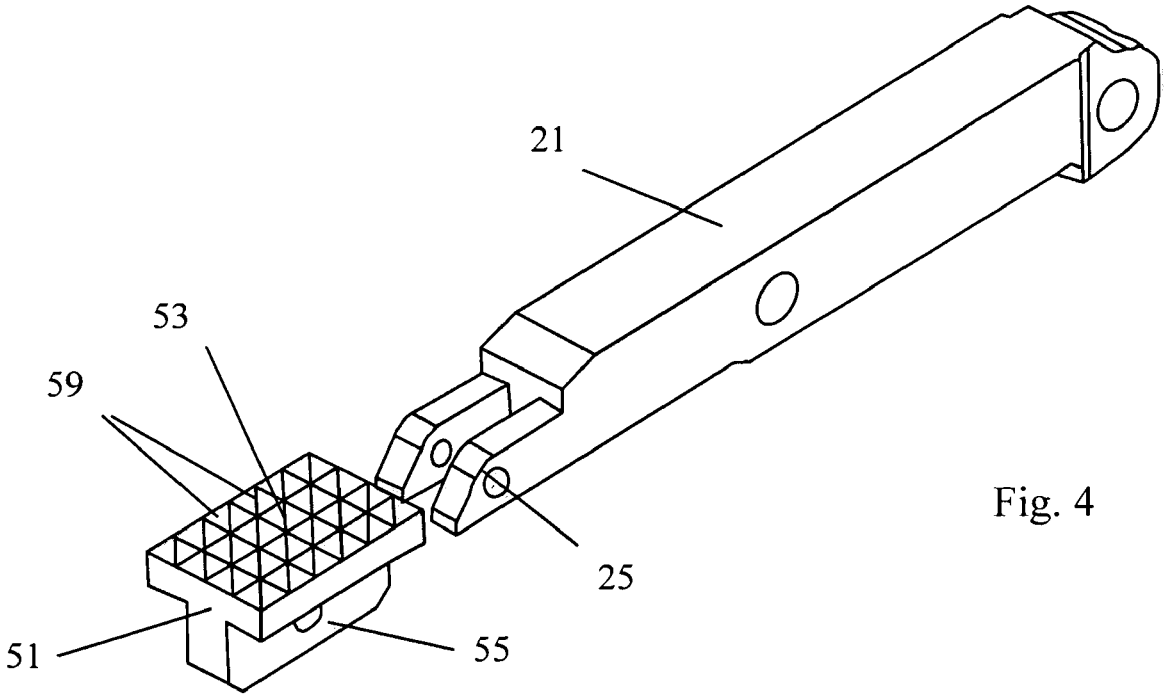
FIG. 4 shows an exploded view of the anchor arm of the present invention, in accordance with a preferred embodiment.

FIG. 4 illustrates the anchor arm 21 of the present invention. The free end of the arm 25 has an articulated pad 51, which pad has a contact face 53. The pad 51 articulates so that the contact face 53 makes full contact with the conduit inside diameter for a wide range of conduit inside diameters.

The free end 25 of the anchor arm 21 has a yoke or receptacle. The pad 51 has a mounting member 55 that is opposite of the contact face 53, which mounting member is received into the yoke. The pad is connected to the arm by a pin 57 (see FIG. 2). Thus, the pad 51 can articulate by pivoting in a plane, which plane contains the arm 21.

The geometry and arrangement of the contact face 53 can vary according to the operating conditions downhole. In the preferred embodiment, the contact face has teeth 59 or other, varied geometric projections arranged across its length and width (when viewing the contact face in plan view). Alternatively, the teeth can be long and located across the length of the contact face, which teeth form ridges or serrations. The number of teeth, the shape of the teeth and the spatial distribution of the teeth can be selected for the particular task at hand. The teeth 59 can be long or short in terms of extending out from the pad, sharp or dull, straight or inclined, staggered or aligned in rows and columns. The teeth can be relatively hard or soft (in terms of Rockwall hardness) and made out of a variety of materials.

The pad 51 can be removed and installed onto the anchor arm 21 with relative ease. This allows an operator to select the particular type of pads 51 most suitable for the particular job or conduit. The operator determines what the downhole borehole conditions are. Various downhole conditions include conduit physical characteristics and also environmental conditions. Conduit physical characteristics include material hardness and strength of the conduit, the condition of the inside surface (smooth or pitted) and so on. Environmental conditions include the type of downhole fluids, the lubrication of such fluids, the friction provided by such fluids, corrosiveness, caking, etc. Once the downhole conditions are known, the operator selects the type of pads to be mounted onto the anchor arms. For example, if the conduit has a layer of mudcake or paraffin on its inside diameter, then the operator may select a pad having relatively long teeth so as to penetrate the layer and make contact with the metal of the conduit. A conduit made of relatively soft material might call for a pad with teeth that are relatively sharp, so as to penetrate into the conduit. Downhole operating conditions that are particularly corrosive may call for pads made out of Ni—Co—Cr—Mo alloy, or other noncorrodible materials.

Once the pads are selected, the operator then mounts the pads onto the arms and readies the tool for insertion into the borehole. The tool is inserted into the borehole, and it is lowered to the desired location. The arms then deploy outwardly.

Figure 5A:
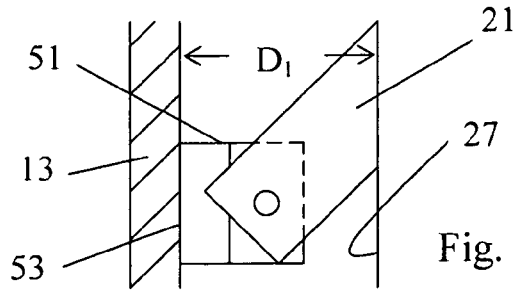
FIGS. 5A and 5B show the articulation of the contact pad on the anchor arm in conduits of different inside diameters.
Figure 5B:
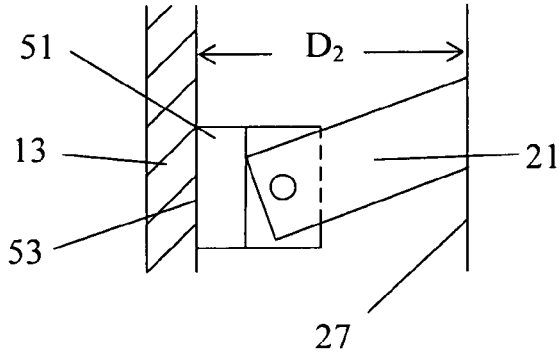

The pads 51 articulates so as to align with the conduit 13 and the full contact face 53 contacts the inside diameter of the conduit. FIGS. 5A and 5B illustrate this. In FIG. 5A, the conduit 13 inside diameter is relatively small. The anchor arm 21 deploys radially outward a distance of $D_1$. The pad 51 and its contact face 53 are aligned with the conduit wall. In FIG. 5B, the conduit 13 inside diameter is larger than that of FIG. 5A. The anchor arm 21 deploys radially outward a distance of $D_2$, which is greater than $D_1$, and yet the pad 51 is aligned with the conduit 13 wall. In both conduits, the teeth of the contact face 53 all contact the conduit.

Figure 6:
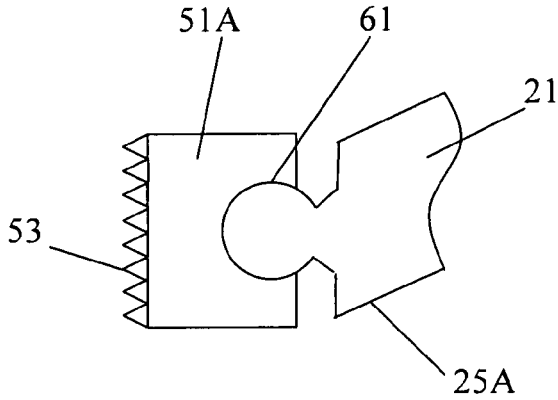
FIG. 6 shows the free end of the anchor arm, in accordance with another embodiment.

FIG. 6 shows another embodiment. The pad 51A is coupled to the anchor arm 21 by a ball and socket arrangement 61. In this embodiment, the pad can not only articulate in a plane containing the anchor arm, but also can articulate from side to side (that is in a circumferential direction when in the borehole). Various other types of articulating connections can be used to couple the pad to the anchor arm.

Figure 7:
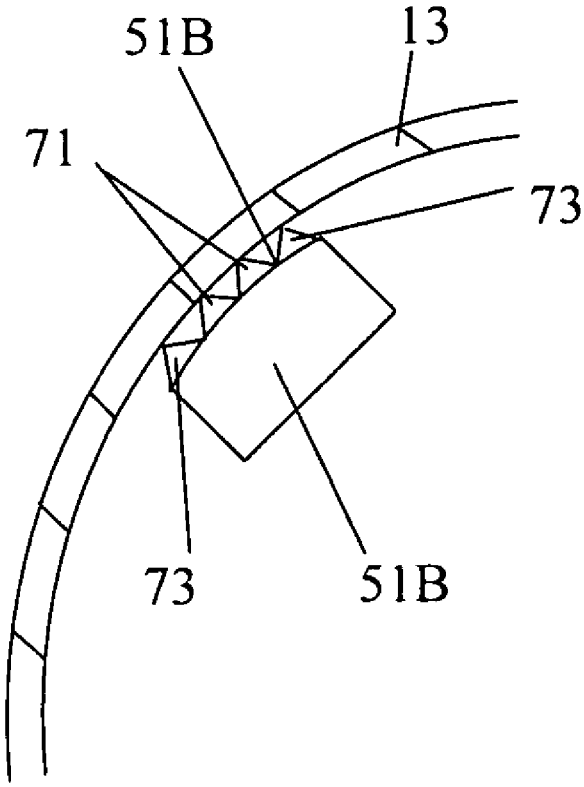
FIG. 7 shows a pad in accordance with another embodiment, in contact with a conduit as shown in a circumferential cross-sectional view of the conduit.

The geometry of the contact face 53 can vary according to the downhole conditions. For example, if the pad is small relative to the inside diameter of the conduit, the circumferential curvature of the contact face can be zero, or straight. However, if the pad 51B is large relative to the inside diameter of the conduit, the pad contact face 53B can be provided with some circumferential curvature as shown in FIG. 7. With the curvature of the pad 51B, the inner teeth 71 and the outer teeth 73 are all in full contact with the conduit 13.

Figure 8:
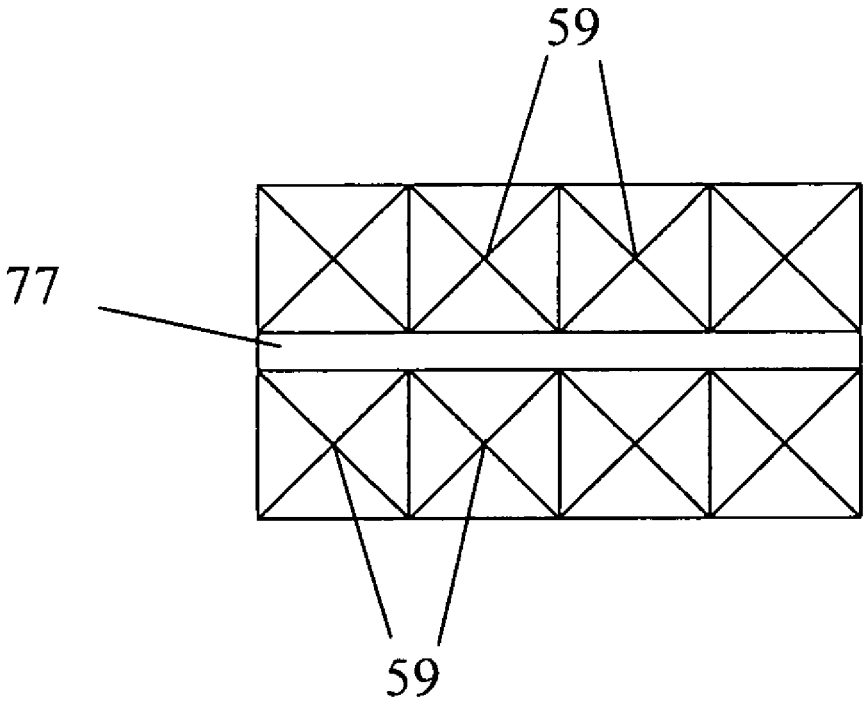
FIG. 8 is a plan view of a tooth configuration of a pad, in accordance with another embodiment.

FIG. 8 illustrates a tooth configuration on a pad. The teeth 59 are similar to those shown in FIG. 4, and are shown in plan view. When all or substantially all of the teeth on the pad are designed to make contact with the conduit, in actual practice, a new problem occurs. If the conduit is lined with mud, rust, etc. then as the pad extends into contact with the conduit, the material or debris may form an incompressible barrier, preventing the teeth from contacting the conduit. One or more channels 77 between the teeth 59 are provided. As the pad is forced into, or loaded against, the conduit, the material or debris exits through the channels 77, so that the teeth 59 make contact with the conduit.

Another way to increase the holding force of the anchors against the conduit is to vary the linkages 21, 29 that force the pads 51 into the conduit. The linkages are the anchor arms 21 and the cam arms 29.

The maximum holding force against the conduit is provided by a linkage configuration where the cam arm is pivotally coupled to the free end of the anchor arm and the arms extend out to a near perpendicular position with respect to the tool. However, other factors come into play. One such factor is the ability to disengage the extended linkages, and their respective pads, from the conduit, while another factor is the length of the actuator in the tool.

To ensure that the arms 21, 29 can be disengaged and the tool freed from the conduit, the angle between the arms 21, 29 is ninety degrees or more. The angle 81 between the cam arm 29 and the anchor arm 21 is measured by a line through the centers of the cam arm pivot points (the cam arm pivots about a pin 83 (see FIG. 2) with respect to the collar 33 and about the pivot connection 21) and another line through the centers of the anchor arm pivot points (the anchor arm pivots about a pin 85 with respect to the tool body 27 and has the pivot pin 31).

The radial holding force increases as the angle decreases from the stowage angle (which is typically slightly less than 180 degrees) to 90 degrees. Thus, the angle is preferably 90 degrees or slightly greater. However, for conduits of differing sizes, a linkage is unable to have a preferred angle.

Figure 9A:
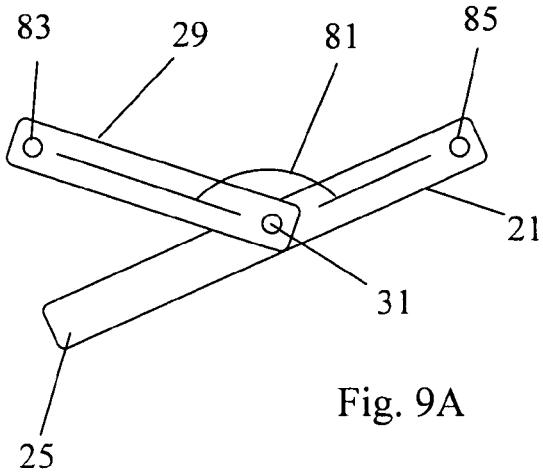
FIGS. 9A-9C are diagrams of the anchor linkages in various geometries.
Figure 9B:
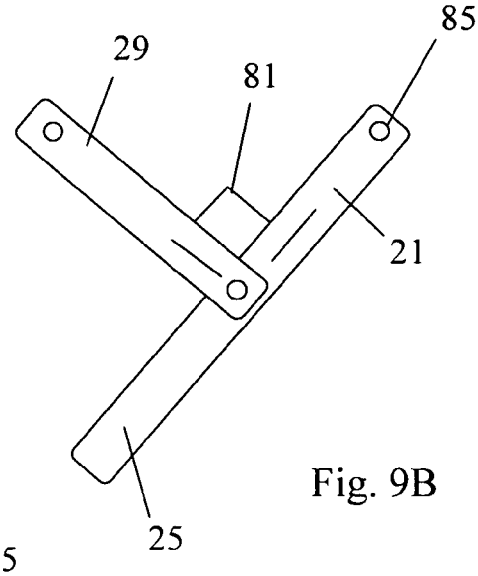
Figure 9C:
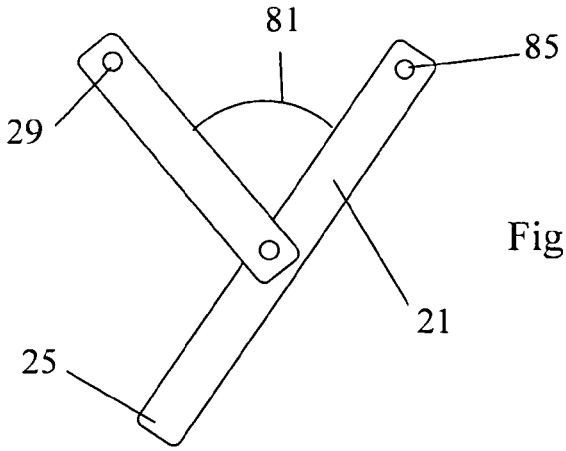

Referring to FIGS. 9A-9C, the same set of linkages 21, 29 is used for different inside diameter conduits. As the anchor arm 21 and its pad 51 is initially pushed outward from a stowed position, the angle 81 between the two arms 21, 29 is much greater than 90 degrees (see FIG. 9A). In a small diameter conduit, the pad would contact the conduit and a radial force would be applied to the conduit by the pad. In a larger diameter conduit, the anchor arm 21 can be pushed out further, until the angle 81 between the arms 21, 29 is at 90 degrees (see FIG. 9B). This provides a greater radial force. As the angle 81 decreases below 90 degrees, as shown in FIG. 9C, the radial force increases. However, the geometry of FIG. 9C is not preferred, because the chance of the free point tool becoming stuck within the conduit increases. If the tool becomes stuck, with the arms extended, it is pulled uphole from the surface. This forces the arms toward the tool.

Figure 11:
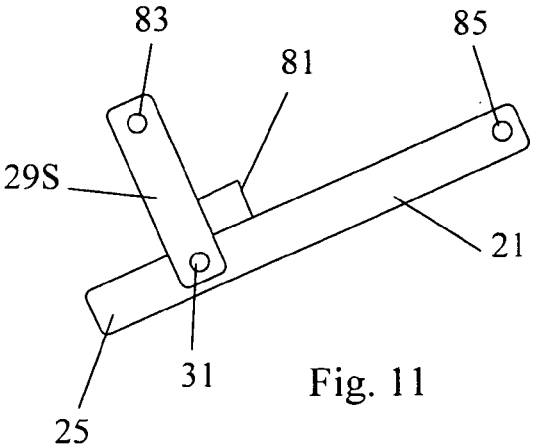
FIG. 11 is a diagram of the anchor linkage in another embodiment, as used in a conduit of smaller diameter than in FIG. 10.
Figure 10:
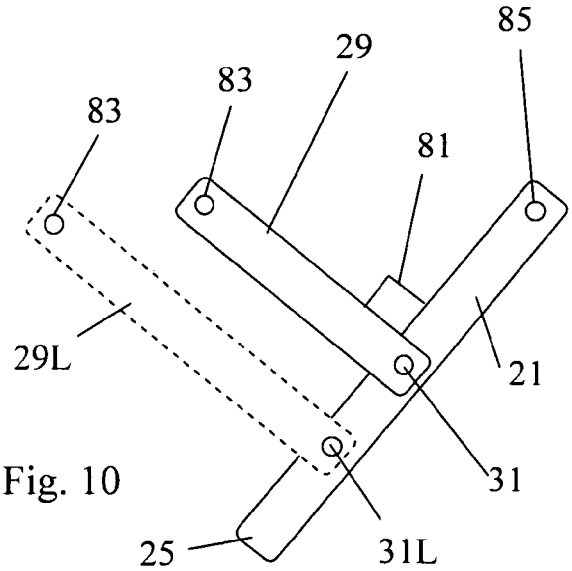
FIG. 10 is a diagram of the anchor linkage of the present invention, as used in a conduit of large diameter.

With the present invention, the linkages 21, 29 can be changed on the free point tool to accommodate the conduit size. For a large diameter conduit, the cam arm 29 has a length and is pivotally coupled 31 to the anchor arm in the middle portion of the anchor arm 21 (see FIG. 10). For a small diameter conduit, the cam arm 29S is either shorter in length, is pivotally coupled to the anchor at a location 31S that is closer to the pad, or a combination of the two (see FIG. 11).

The linkages can be changed from what is shown in the drawings. For example, in the drawing of FIG. 10, which is for a large diameter conduit, the cam arm 29 can be lengthened (shown in dashed lines as 29L) and the pivot point 31L moved out toward the free end. This increases the radial force on the conduit, but requires an actuator with a longer stroke. Some tool designs may require relatively short actuator strokes.

The arms 21, 29 are changed out by removing their pins 31, 83, 85 or bolts that couple the arms to the free point tool. If the free point tool is equipped with a set of arms for a small size conduit, and the free point tool is to be used in a large diameter conduit, the arms are changed to avoid a geometry as shown in FIG. 9C. A suitable set of arms for use in a large size conduit is one which arms form a 90 degree angle between the cam arm and the anchor arm at a distance (or radius from the tool centerline) that is slightly greater than the conduit inside radius. This will ensure that the arms extend to an angle that is 90 degrees or greater. Likewise, if a free point tool is equipped with a set of arms from a large diameter conduit and the free point tool is to be used in a smaller diameter conduit, the arms are changed to obtain more radial force. The arms extend to a 90 degree angle at a radius that is slightly greater than the conduit inside radius. For a conduit inside radius, the set of arms having the angle closest to, but not less than, 90 degrees when the arms are extended to the inside conduit radius is selected.

By using the articulating pads 51, which contact the conduit with a number of teeth, and by utilizing the arm arrangement that provides a large radial force for the conduit size, the holding force provided by the anchors and the free point tool is increased. Furthermore, the anchors can be released from the conduit in a reliable manner and the free point tool retrieved. The present invention minimizes the unintentional release and the unintentional sticking of a free point tool in the conduit.

The foregoing disclosure and showings made in the drawings are merely illustrative of the principles of this invention and are not to be interpreted in a limiting sense.

The invention claimed is:

1. An apparatus for locating a free point in a stuck conduit in a borehole, comprising:

a) at least one sensor to measure deformation of the conduit;

b) a set of anchors located adjacent to, and on each side of the sensor;

c) the anchors comprise anchor arms that move from a stowed position to an extended position;

d) each of the anchor arms have a pad with a contact face, the contact face structured and arranged to engage the conduit, each pad coupled to the respective arm in an articulating manner, the apparatus having an uphole end and a downhole end, the respective anchor arms extend only in the direction of the uphole end from the pad.

2. The apparatus of claim 1 wherein the pads are coupled to the anchor arms by respective pin joints.

3. The apparatus of claim 1 wherein the pads are coupled to the anchor arms by respective ball joints.

4. The apparatus of claim 1 wherein the contact face comprises teeth arranged across a length of the contact face.

5. The apparatus of claim 1 wherein the contact face comprises teeth arranged across a length and width of the contact face.

6. The apparatus of claim 1 wherein the contact face of each pad is curved in a circumferential direction so as to improve conformance with an inner surface of the conduit.

7. The apparatus of claim 1 wherein each of the teeth have a base, the contact face of each pad comprises teeth arranged in a pattern with a channel between at least some of the teeth bases so as to allow for debris exit upon loading of the pad against the conduit.

8. The apparatus of claim 1 wherein each pad is removably coupled to the respective anchor arm.

* * * * *